US008919008B2

(12) United States Patent
Bauböck et al.

(10) Patent No.: US 8,919,008 B2
(45) Date of Patent: Dec. 30, 2014

(54) YANKEE DRYER FOR DRYING A PULP WEB

(75) Inventors: Jörg Bauböck, Graz (AT); Gernot Tropper, Graz (AT)

(73) Assignee: Andritz AG, Graz (AT)

( * ) Notice: Subject to any disclaimer, the term of this patent is extended or adjusted under 35 U.S.C. 154(b) by 819 days.

(21) Appl. No.: 13/068,246

(22) Filed: May 6, 2011

(65) Prior Publication Data

US 2014/0068961 A1 Mar. 13, 2014

(30) Foreign Application Priority Data

May 6, 2010 (AT) ..... 763/2010

(51) Int. Cl.
*F26B 13/18* (2006.01)
*D21F 5/02* (2006.01)

(52) U.S. Cl.
CPC ..... *F26B 13/18* (2013.01); *D21F 5/021* (2013.01)
USPC ..... 34/119; 34/446

(58) Field of Classification Search
CPC ..... F26B 11/02; F26B 3/00; F26B 13/18; F28D 11/02; D06F 58/00; D21F 5/02; D21G 3/04
USPC ..... 34/119, 446
See application file for complete search history.

(56) References Cited

U.S. PATENT DOCUMENTS

| | | | | | |
|---|---|---|---|---|---|
| 3,022,047 | A * | 2/1962 | Swaney | 165/89 |
| 3,633,662 | A * | 1/1972 | Voll | 165/89 |
| 3,808,700 | A * | 5/1974 | Kraus | 34/124 |
| 3,919,783 | A * | 11/1975 | Cirrito | 34/450 |
| 4,196,689 | A | 4/1980 | Wolf et al. | 165/91 |
| 6,161,302 | A * | 12/2000 | Rantala | 34/119 |
| 6,683,284 | B2 * | 1/2004 | Nyman et al. | 219/469 |
| 8,398,822 | B2 * | 3/2013 | Mennucci et al. | 162/357 |
| 2010/0132903 | A1 * | 6/2010 | Mennucci et al. | 162/357 |

FOREIGN PATENT DOCUMENTS

| | | |
|---|---|---|
| DE | 27 07 923 | 8/1978 |
| WO | WO2008/105005 | 9/2008 |

* cited by examiner

*Primary Examiner* — Steve M Gravini
(74) *Attorney, Agent, or Firm* — Alix, Yale & Ristas, LLP

(57) ABSTRACT

The invention relates to a Yankee dryer (1) made of steel with a cylindrical steel shell (2) that is closed off at each end by a cylinder end cover (3, 4). According to the invention the Yankee dryer (1) has a one-piece central shaft (7) with a first and a second connecting flange (8, 9) to join the central shaft (7) to the end covers (3, 4), where the diameter of the first connecting flange (8) is smaller than the diameter of the opening (6) in the second end cover (4) so that the central shaft (7) can be pushed through this opening (6) into the Yankee cylinder (1). The invention also refers to a manufacturing process for a Yankee dryer (1).

17 Claims, 3 Drawing Sheets

YANKEE DRYER FOR DRYING A PULP WEB

BACKGROUND

The present invention relates to a Yankee dryer made of steel for drying a pulp web, with a cylindrical steel shell that is connected to a first and second cylinder end cover at either end, where the cylinder end covers each have an opening at their centre, and to a process for manufacturing a Yankee dryer.

In production of paper webs, particularly for tissue, it is common practice to use so-called Yankee dryers in the drying process. Yankee dryers usually have a very large diameter. They are heated with steam and are difficult to manufacture because there are high demands to be met concerning internal pressures, leak tightness, and the large diameters.

Yankee dryers customary in the trade have the following dimensions, for example:

| | |
|---|---|
| Cylinder diameter: | 3000 mm to 5500 mm |
| Diameter of Hollow shaft: | 1500 mm to 1800 mm |
| Cylinder width: | 6000 mm to 7500 mm |
| Cylinder mass: | 40 t to 95 t |

These cylinders are made predominantly of cast iron, however Yankee dryers made of steel are also already known from U.S. Pat. No. 4,196,689 and DE 2707923. Normally a Yankee dryer consists of a cylindrical shell surface that is closed off at the ends by cylinder end covers of various shapes. The two covers can be bolted or welded to the cylinder shell.

A Yankee dryer rotates in bearings by means of journals and contains a hollow shaft or axle through which the steam for heating can be fed to the cylinder and the waste steam and condensate can be removed.

WO2008/105005 discloses a Yankee dryer made of steel with a central shaft in several sections. This means that the two bearing journals of the Yankee dryer are attached to the end covers separately from a hollow shaft inside the dryer, using bolts for example (see FIG. 1). This embodiment has the disadvantage that a large number of bolts and flanges are required, which weaken the component. Furthermore there are more components with tolerances to be machined, thus there may be imprecise bearing alignment.

Conventional Yankee dryers, as illustrated in WO2008/105005, are manufactured in the following assembly sequence:

1. The cylinder shell is placed on the first end cover and joined to it (bolted or welded).
2. The hollow shaft with the steam and condensate pipes attached to it is placed inside the cylinder.
3. The hollow shaft is welded or bolted to the first end cover.
4. The second end cover is placed on the cylinder shell and joined to the cylinder shell and the hollow shaft.
5. The bearing journals are affixed to the end covers.

Due to the safety regulations for manufacture of pressure vessels, the end covers must be welded to the shell on both sides, i.e., on the inside and on the outside. The conventional assembly sequence has the disadvantage that the root weld between the second cover and the cylinder shell on the inside of the cylinder can only be made by entering the cylinder through the manhole in the end cover. This leads to more difficult working conditions for the welders on the one hand (lack of air, light, and space) and presents a much higher risk of accidents on the other hand.

SUMMARY

The object of the invention is to provide a Yankee dryer made of steel that is easier to manufacture.

According to the present disclosure, the Yankee dryer has a one-piece central shaft with a first and a second connecting flange to join the central shaft to the end covers. The diameter of the first connecting flange is smaller than the diameter of the opening in the second end cover so that the central shaft can be pushed through this opening into the Yankee cylinder.

Due to the one-piece central shaft, the steel shell of the Yankee dryer can be joined first of all to the two end covers, preferably welded. Thus, the inside of the Yankee is easily accessible because the two openings in the covers are quite large (approx. 1500 mm), making it easy to perform welding work inside the Yankee.

The one-piece central shaft is not inserted into and joined to the cylinder until the end covers have been joined to the steel shell. In addition, handling is easier during assembly because there are fewer components.

Advantageously the diameter of the first connecting flange is larger than the opening in the first end cover. The first connecting flange is thus on the inside of the first end cover after the central shaft has been inserted and can be joined to it easily, by bolting for example.

It is also favorable if the diameter of the second connecting flange is larger than the opening in the second end cover because the second connecting flange then rests on the outside of the second end cover when the central shaft has been inserted and can be joined to it easily (bolted for example).

Thus, the central shaft has connecting flanges at both ends, but with different diameters. It is an advantage if the connecting flange at the operator-side end has a larger diameter than the connecting flange on the drive-side end. Due to this special design of the central shaft and with an appropriate screw joint between the central shaft and the end covers, a facility is also created for changing the central shaft in a non-destructive process. The current state of the art does not disclose any embodiments that make it possible to remove the shaft, if there is a leakage problem for example, without ruining the end covers and usually also the cylinder shell.

It is another objective of the invention to provide a simpler manufacturing process for a Yankee dryer.

The manufacturing process according to the present disclosure for a Yankee cylinder made of steel comprises the following steps:

1. One end of a cylindrical steel shell is placed on a first end cover and joined to it, particularly welded;
2. A second end cover is joined to the other end of the cylindrical steel shell, particularly welded;
3. A one-piece central shaft with connecting flanges is inserted into or placed inside the cylinder through an opening in the end cover;
4. The connecting flanges of the central shaft are then each joined to the end covers.

Thus, the central shaft is not placed inside the cylinder until both end covers have been joined firmly to the cylinder shell. Welding work to join the shell to the covers need no longer be performed through the manhole.

As a practical matter, only the two finish-machined components—the central shaft and the cylinder with end covers—have to be assembled. This also reduces the risk of errors during assembly compared to dryers consisting of several components.

The connecting flanges of the central shaft can either be bolted or welded to the end covers. If they are bolted, this provides the option of making the central shaft easy to replace.

BRIEF DESCRIPTION OF THE DRAWING

In the following, an embodiment is described with the reference to the accompanying drawing, wherein.

DETAILED DESCRIPTION

Figure 1:
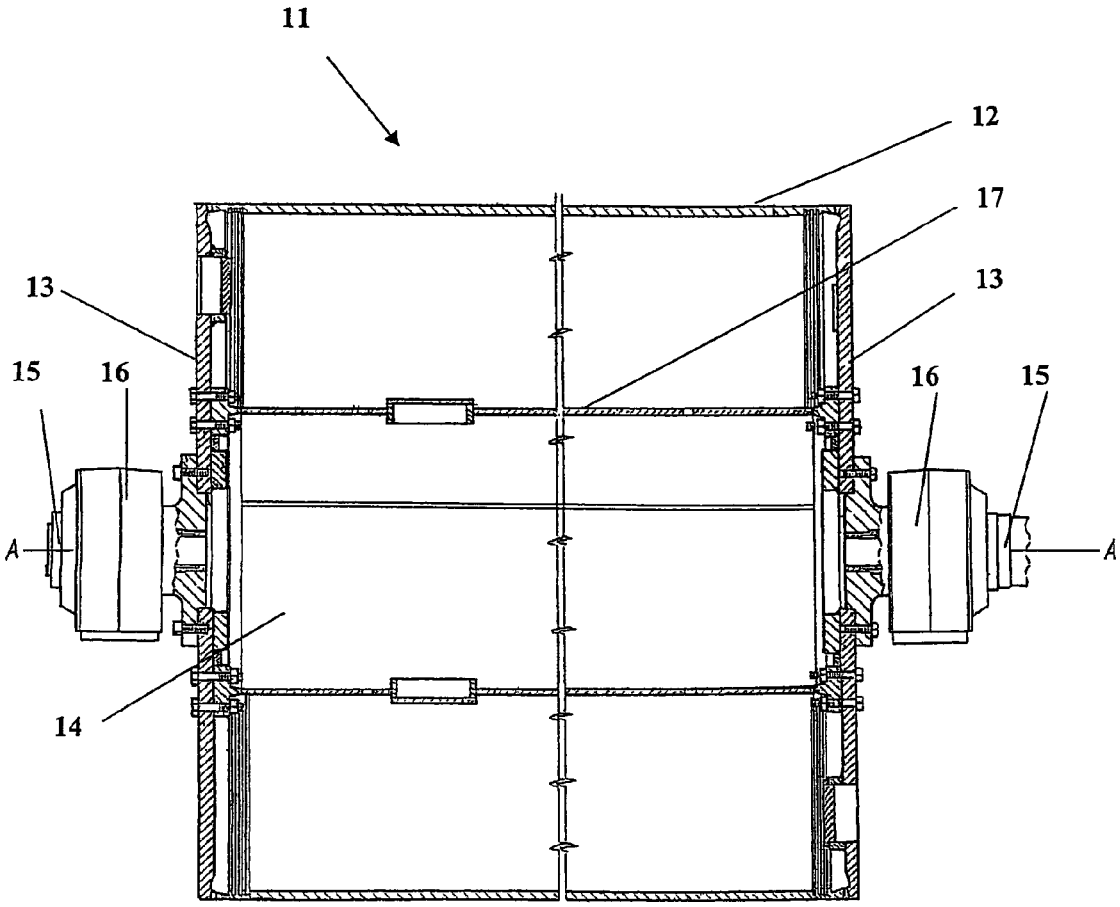
FIG. 1 shows a state-of-the-art Yankee dryer made of steel, as is disclosed in WO 2008/105005.

FIG. 1 shows a state-of-the-art Yankee dryer 11, featuring a cylindrical steel shell 12 that is welded to the two coaxially arranged end covers 13. The Yankee dryer has a multi-part central shaft 14 comprising the two bearing journals 15 and a cylindrical connecting piece 17 inside the cylinder. The two bearing journals 15 and the connecting piece 17 are bolted to the end covers 13. The two bearing journals 15 rotate in roller bearings 16.

In the manufacture of this Yankee dryer 11, the steel shell 12 is first joined to one of the two end covers 13. Then the connecting piece 17 (hollow shaft) is placed inside the cylinder and bolted to the end cover 13. After this the second end cover 13 is placed on the top end of the steel shell 12 and welded to the cylinder shell or bolted to the connecting piece 17. The steel shell 12 must be welded to the end covers 13 from the inside and the outside of the cylinders, thus the second end cover 13 has to be welded to the steel shell 12 through a manhole in the end cover. Subsequently the two bearing journals 15 are bolted to the respective end covers.

Figure 2:
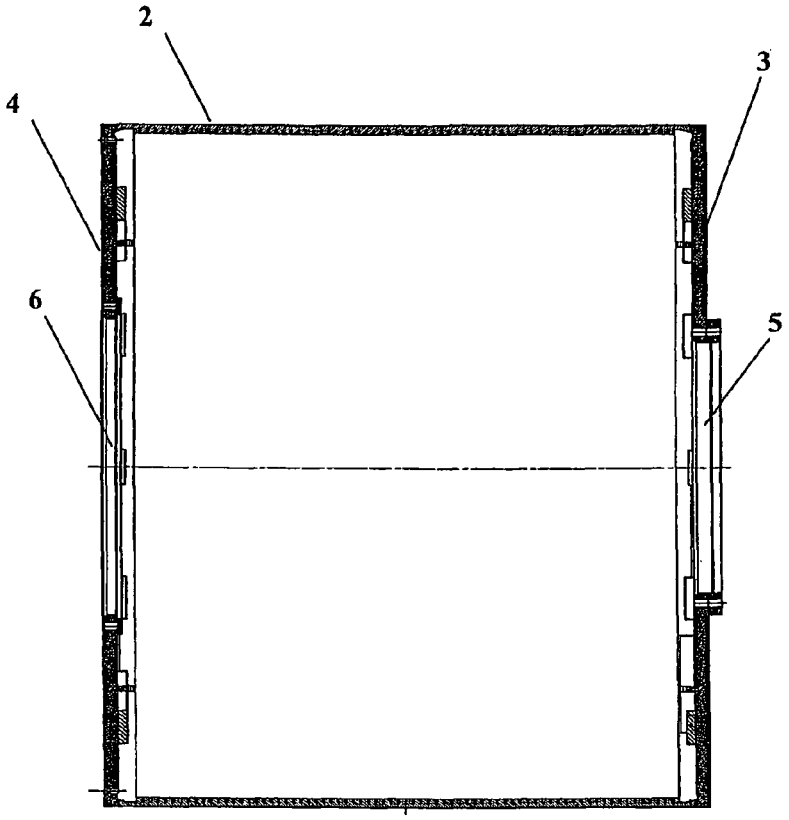
FIG. 2 shows the cylinder shell according to an embodiment of the invention with the two end covers.

FIG. 2 shows the cylindrical steel shell 2 of the Yankee dryer according to an embodiment of the invention. The steel shell 2 is joined to a first end cover 3 and a second end cover 4. The two end covers 3, 4 each have a circular opening 5, 6 in the centre to hold the central shaft 7.

Figure 3:
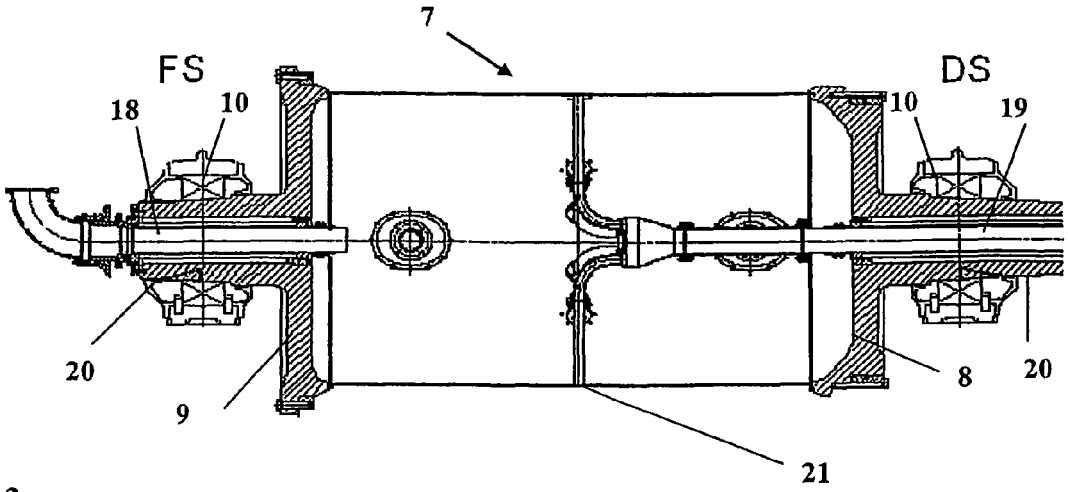
FIG. 3 shows an embodiment of a one-part central shaft, which is placed inside the cylinder shell according to FIG. 2.

The one-piece (unitary) central shaft 7 is shown in FIG. 3. This means that the central shaft 7 forms a single component after manufacture, made up of several parts if necessary, and this component is then placed inside the steel shell 2. The one-piece central shaft 7 includes the bearing journals 20, the two connecting flanges 8 and 9, and a central part 21. This central shaft 7 is assembled before being placed inside the steel shell 2. The central shaft rotates in the bearings 10. Steam can be supplied to the Yankee dryer during operation through the steam feed 18. Waste steam or condensate is carried off through the pipe 19.

Figure 4:
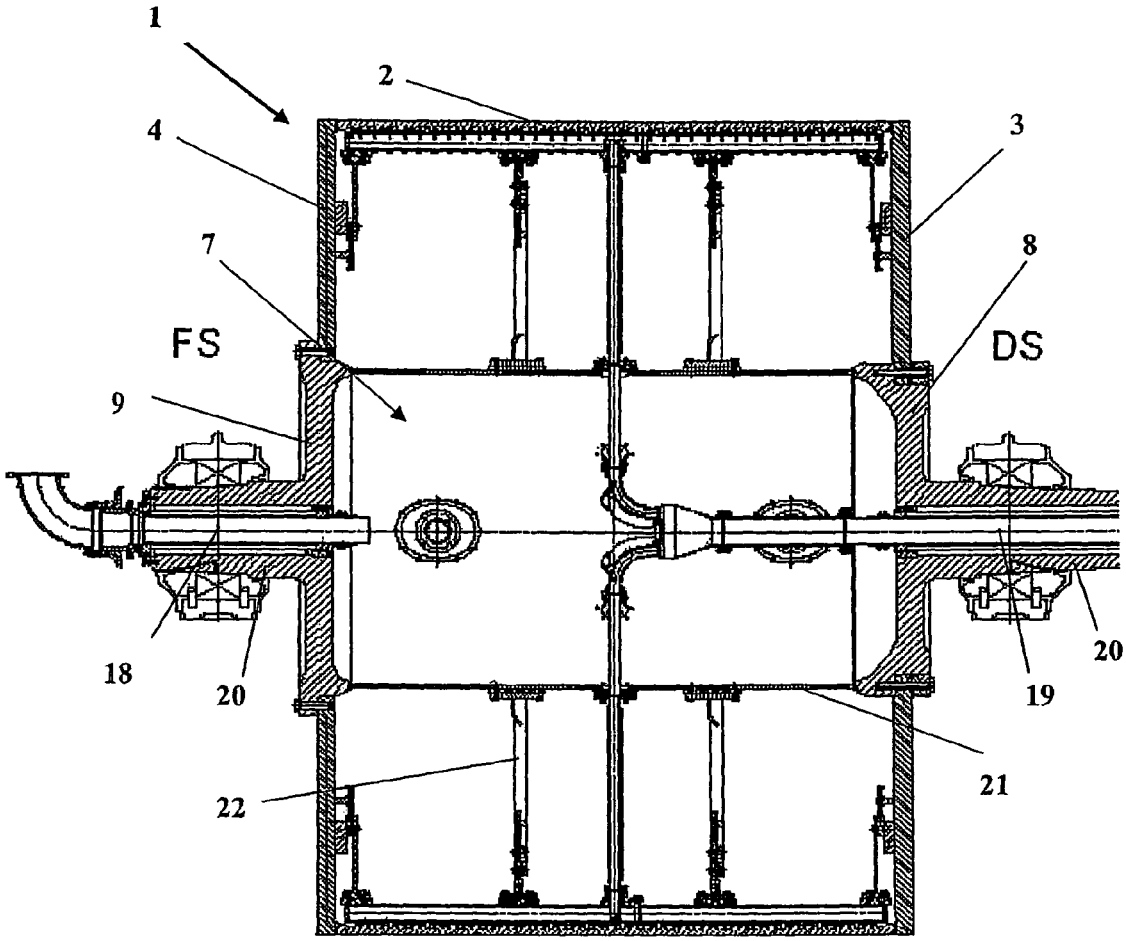
FIG. 4 shows the assembled Yankee dryer according to the embodiment of FIGS. 2 and 3.

FIG. 4 shows the Yankee dryer 1 fully assembled. In the manufacture of this Yankee dryer 1, one end of the cylindrical steel shell 2 is placed on the first end cover 3 and joined to it, by bolting or welding for example. Then the second end cover 4 is joined to the other end of the cylindrical steel shell 2. The result is a pre-assembled steel cylinder as shown in FIG. 2. The two end covers 3 and 4 each have openings 5 and 6 to hold the central shaft 7. FIG. 2 shows that the opening 5 in the first end cover 3 is a little smaller than the opening 6 in the second end cover 4.

In a further assembly step, the pre-assembled, one-part central shaft 7 is placed inside the steel shell 2 through the opening 6 in the second end cover 4. The diameter of the first connecting flange 8 of the central shaft 7 must be smaller than the opening 6 here so that the central shaft 7 can be placed inside the cylinder.

In the present example, the diameter of the first connecting flange 8 is slightly larger than the opening 5 in the first end cover 3. As a result, the connecting flange 8 rests on the axially inner side margin of the first end cover 3 after the central shaft 7 has been inserted (see FIG. 4). The first end cover 3 can thus be bolted easily to the first connecting flange 8 from the outside.

Similarly, the diameter of the second connecting flange 9 is slightly larger than the opening 6 in the second end cover 4. As a result, the connecting flange 9 rests on the axially outer side margin of the end cover 4 after the central shaft 7 has been placed inside the cylinder and can therefore be bolted to it without any difficulty. This special design also allows the central shaft 7 to be removed easily. The pipes 22 are not mounted until after the central shaft 7 has been installed.

The same principles of construction and manufacturing method can be applied even if the openings in the covers are not circular, so long as the shapes of the flanges have the described relation for the areas of the openings.

The invention claimed is:

1. In a Yankee dryer (1) made of steel with a cylindrical shell (2) that is connected to coaxial first and second end covers (3, 4), where the end covers (3, 4) each have a circular opening (5, 6) centered on the cylinder axis, the improvement comprising a one-piece rotatable central shaft (7) extending coaxially through the shell with a first and a second connecting flange (8, 9) respectively joining the central shaft (7) to the first and second end covers (3, 4) for rotating the cylindrical shell, wherein the first connecting flange (8) has a diameter that is smaller than the diameter of the opening (6) in the second end cover (4) such that the central shaft (7) can pass through the opening (6) in the second end cover.

2. The Yankee dryer according to claim 1, wherein the diameter of the first connecting flange (8) is larger than the opening (5) in the first end cover (3).

3. The Yankee dryer according to claim 1, wherein the second connecting flange (9) has a diameter that is larger than the opening (6) in the second end cover (4).

4. The Yankee dryer according to claim 1, wherein the connecting flanges (8, 9) of the central shaft (7) are bolted to the end covers (3, 4).

5. A Yankee dryer comprising:

a cylindrical steel shell (2) defining a central axis and having first and second axial ends;

a first end cover (3) connected to the first end of the shell and a second end cover (4) connected to the second end of the shell, said covers having respective first and second openings (5, 6) with respective first and second open areas centered on said axis and respective first and second margins around the openings;

a rotatable, unitary central shaft (7) extending along said axis between first and second ends, wherein the first end has a first flange (8) connected to the axially inner margin of said first opening (5) and the second end has a second flange (9) connected to the axially outer margin of said second opening (6), thereby joining the unitary shaft to the end covers for rotating the cylindrical shell.

6. The Yankee dryer according to claim 5, wherein the first flange (8) has a shape that is smaller than the area of the opening (6) of the second cover (4);

the shape of the first flange (8) is larger than the area of the first opening (5); and the shape of the second flange (9) is larger than the area of the second opening (6).

7. The Yankee dryer according to claim 6, wherein the flanges (8, 9) are bolted to the margins of the openings (5, 6).

8. The Yankee dryer according to claim 7, wherein the shell (2) is welded to the end covers (3, 4).

9. A method for manufacturing a Yankee dryer (1) made of steel, comprising the following steps:

a) one end of a cylindrical steel shell (2) is placed on and joined to a first end cover (3);

b) a second end cover (4) is joined to the other end of the cylindrical steel shell (2);

c) a one-piece central shaft (7) with connecting flanges (8, 9) is inserted into the inside of the cylinder through an opening (5, 6) in an end cover (3, 4); and d) the connecting flanges (8, 9) are then each joined to the end covers (3, 4).

10. The method according to claim 9, wherein the connecting flanges (8, 9) are bolted to the end covers (3, 4).

11. The method according to claim 9, wherein the connecting flanges (8, 9) are welded to the end covers (3, 4).

12. The method according to claim 9, wherein the shell (2) is joined to the end covers (3, 4) by welding.

13. The method according to claim 12, wherein the connecting flanges (8, 9) are bolted to the end covers (3, 4).

14. The method according to claim 12, wherein the connecting flanges (8, 9) are welded to the end covers (3, 4).

15. The Yankee dryer according to claim 1, wherein the one-piece central shaft (7) includes a central part (21) joined to the connecting flanges (8, 9) and a bearing journal (20) extending coaxially from each connecting flange (8, 9).

16. The Yankee dryer according to claim 5, wherein the unitary central shaft (7) includes a central part (21) joined to the flanges (8, 9) and a bearing journal (20) extending coaxially from each flange (8, 9).

17. The method of claim 9, wherein at any time before step (c), the one-piece shaft (7) is pre-assembled by joining the connecting flanges (8, 9) with coaxially extending bearing journals (20) to a central part (21).

* * * * *